US006375385B1

(12) United States Patent
Kennedy

(10) Patent No.: US 6,375,385 B1
(45) Date of Patent: Apr. 23, 2002

(54) FLEXIBLE SUPPORT

(76) Inventor: Gregory B. Kennedy, 210 Argonaut Rd., St. Augustine, FL (US) 32086

( * ) Notice: Subject to any disclaimer, the term of this patent is extended or adjusted under 35 U.S.C. 154(b) by 0 days.

(21) Appl. No.: 09/411,378

(22) Filed: Oct. 4, 1999

Related U.S. Application Data

(60) Provisional application No. 60/104,404, filed on Oct. 15, 1998.

(51) Int. Cl.[7] ..... E01F 9/017; E01F 9/011; E01F 9/03

(52) U.S. Cl. ..... 404/10; 404/9; 116/63 R; 40/612; 248/174; 248/417

(58) Field of Search ..... 404/9, 10; 116/63 R, 116/63 P; 40/612; 248/417, 174, 415

(56) References Cited

U.S. PATENT DOCUMENTS

| | | | | | |
|---|---|---|---|---|---|
| 3,521,917 | A | * | 7/1970 | King | 404/10 |
| 3,716,953 | A | * | 2/1973 | Moore | 52/2.15 |
| 3,799,686 | A | | 3/1974 | Williams | |
| 3,875,720 | A | | 4/1975 | Russell | |
| 4,019,271 | A | * | 4/1977 | Latimer | 40/612 |
| 4,061,435 | A | | 12/1977 | Schmanski et al. | |
| 4,084,914 | A | * | 4/1978 | Humphrey et al. | 404/10 |
| 4,092,081 | A | | 5/1978 | Schmanski | |
| 4,126,403 | A | * | 11/1978 | Sweeney et al. | 404/10 |
| 4,245,922 | A | * | 1/1981 | Auriemma | 404/10 |
| 4,435,107 | A | | 3/1984 | Sweeney | |
| 4,486,117 | A | | 12/1984 | Blau | |
| 4,958,954 | A | | 9/1990 | Schmanski et al. | |
| 5,028,166 | A | * | 7/1991 | Leishman | 404/10 |
| 5,125,194 | A | * | 6/1992 | Granger | 404/10 |
| 5,205,236 | A | * | 4/1993 | Hughes | 116/63 R |
| 5,267,523 | A | | 12/1993 | Hugron | |
| 5,788,405 | A | * | 8/1998 | Beard | 40/612 |
| 5,957,425 | A | * | 9/1999 | Conway et al. | 404/10 |
| 6,068,233 | A | * | 5/2000 | Green | 404/10 |

* cited by examiner

*Primary Examiner*—Thomas B. Will
*Assistant Examiner*—Alexandra K. Pechhold
(74) *Attorney, Agent, or Firm*—Richard C. Litman

(57) ABSTRACT

A flexible support is constructed by mechanically laminating a plurality of relatively wide, thin, elongate flexible members together. The members are preferably formed of spring steel, and each individually is quite flexible due to the thin configuration. Preferably, each of the members is curved about its longitudinal axis to provide additional rigidity. The members are used to support traffic delineators, road signs, and/or other objects as desired, with the strength and resiliency required being adjusted by adjusting the number of individual members comprising each laminated support. The flexibility may be further adjusted by placement of one or more tension adjusters at one or more points along the length of the laminated support, with the attachments for the tension adjusters also being used to secure the laminations together. The fasteners used may be installed through holes formed through the support, or may pass laterally about the sides or edges of the support. The tension adjusters may also be used for securing signs or other objects to the support, and/or for the attachment of additional brackets extending laterally from the support for holding additional signs or other objects. A cap may also be installed for holding a street sign or other object at the upper end of the support, if so desired. The present flexible support is particularly well suited for use in displaying road signs and the like, with its construction allowing it to flex over when struck, and to return to its upright position afterwards.

17 Claims, 5 Drawing Sheets

FLEXIBLE SUPPORT

REFERENCE TO RELATED PATENT APPLICATION

This application claims the benefit of U. S. Provisional Patent Application Ser. No. 60/104,404, filed on Oct. 15, 1998.

BACKGROUND OF THE INVENTION

1. Field of the Invention

The present invention relates generally to cantilever support structures for signs and other articles, and more specifically to a flexible support for such signs and articles. The support is formed generally of a plurality of relatively thin sheets of material laminated together, with the flexibility of each of the sheets providing sufficient flexibility to "give" when struck by a car or the like. Each of the thin components is curved about its elongate axis, in order to provide sufficient stiffness for the support of a sign or the like under normal conditions.

2. Description of the Related Art

Traffic information, warning, directional, and other signs have been known since shortly after the development of the motor vehicle. Such signs are a critical part of our road transportation system, and oftentimes the removal of a single sign from a critical location, can be disastrous. This can occur when a stop sign is removed from a busy intersection, or perhaps where a vehicle inadvertently knocks down a row of lane delineators marking a lane shift, curve, or other potential hazard.

It will be seen that the need for durable sign posts or supports for such signs is critical in many cases. Nevertheless, such markers and signs are installed and maintained by various governmental agencies, which operate under certain budgetary constraints. While it is possible to construct such sign supports which are sufficiently durable to withstand years of service in the outdoor environment, it is difficult to do so at a reasonable cost, and particularly to fabricate such supports in a manner that is not hazardous to traffic. Flexible plastic delineator posts have been developed in the past, but such posts are easily run down and damaged by some drivers, and the plastic material is subject to weakening and degradation by exposure to sunlight (ultraviolet).

Alternatively, "breakaway" sign posts and supports have been developed for installation in many areas, but are relatively costly due to their specifically configured weak points in order to allow them to be snapped off or broken upon impact. While such breakaway posts and supports may increase safety for the vehicle impacting the support post or column, surrounding traffic and property may be endangered by the sign and column as it becomes a projectile after breaking away upon impact. In addition, the problem exists of the lack of a sign at the subject location until the appropriate agency gets around to replacing the downed sign.

Accordingly, a need will be seen for a flexible support which is capable of flexing resiliently to absorb the impact of a car or other traffic. The support preferably provides for flexure back to its original position once the impact source is removed (e. g., the vehicle passes completely over the sign and support), in order to be readily visible to other traffic. Moreover, the device must be easily constructed of economical and durable materials in order to provide for widespread use and long life.

A discussion of the related art of which the present inventor is aware, and its differences and distinctions from the present invention, is provided below.

U.S. Pat. No. 3,799,686 issued on Mar. 26, 1974 to Clarence Williams, titled "Marker Posts," describes a post or column construction comprising a series of identical, vertically stacked hard rubber elements having a pair of flexible cables running vertically through the elements to connect them together.

The device differs considerably from the present invention, in that the Williams device is considerably more complex, having a pair of vertical tensile cable members in addition to a vertical stack of resilient components. The present invention basically comprises a plurality of thin, vertically oriented slats which are laminated together by a relatively few bolts, which are also used to adjust the desired stiffness and resiliency of the assembly.

U.S. Pat. No. 3,875,720 issued on Apr. 8, 1975 to Kennedy M. Russell, titled "Resilient Mounting For Sign Post," describes a post formed of a plurality of relatively thin resilient rods, secured by upper and lower U-bolt attachments or the like. The resilient rods allow the post to bend upon impact. The structure is unlike the plurality of thin, flat elements forming the flexible support or column of the present invention.

U.S. Pat. No. 4,061,435 issued on Dec. 6, 1977 to Donald W. Schmanski et al., titled "Roadway Delineator," describes various configurations of posts, each of which includes a plurality of intentionally weakened longitudinal shear lines therein. The post will shear along these lines when struck, thereby allowing the resulting relatively thin vertical elements to flex. Schmanski et al. state that their delineator posts may be reused after impact, but also note that they must be repaired with the addition of other components to provide the required strength after shearing impact. The present flexible support does not require any such repair after impact, as it is formed of a plurality of individual flexible elements which are mechanically secured together.

U.S. Pat. No. 4,084,914 issued on Apr. 18, 1978 to William D. Humphrey et al., titled "Self-Erecting Highway Guide Post," describes a post having a first component with a flat center section and opposite angled flanges extending therefrom, with an additional curved member resting within the channel defined by the first member. The device provides flexibility, but the provision of only two vertical members with a space therebetween, does not provide the strength of the present support structure. Other embodiments are disclosed, but in each case, either the second member is eliminated, or faces the first member with their concave faces toward one another to define a space therebetween, unlike the present laminated flexible support. Moreover, the Humphrey et al. post elements are formed of a thermoplastic material, rather than the more durable spring steel of the present support members.

U.S. Pat. No. 4,092,081 issued on May 30, 1978 to Donald W. Schmanski, titled "Roadway/Traffic Delineator," describes a post formed of bonded laminations of synthetic fiber material. The laminations include directional fibers, but also include other layers having non-directional or other than longitudinal directional orientation. Schmanski does not disclose the use of plural thin metal slats, or any curvature thereof, for providing the stiffness and bending qualities of the present invention.

U.S. Pat. No. 4,245,922 issued on Jan. 20, 1981 to Robert S. Auriemma, titled "Traffic Delineator Post," describes a post having an arcuate cross section and formed of a single, monolithic unit of plastic or fiberglass. No multiple laminations, mechanically secured together, are disclosed by Auriemma, which multiple laminations are a part of the present invention. As noted further above, plastics (including the plastic resin matrix material used in fiberglass materials) do not have the durability of metals when continually exposed to sunlight and ultraviolet light. The present metal materials overcome this problem.

U.S. Pat. No. 4,435,107 issued on Mar. 6, 1984 to Lawrence J. Sweeney, titled "Traffic Delineator," describes a marker having a rigid base for driving into a hard surface (pavement, etc.). The upper portion may be arcuately formed for stiffness. However, the Sweeney device is formed of plastic for flexibility, with the limitations of such material being noted further above. Also, Sweeney provides only a single panel of material, unlike the multiple metal laminations of the present support.

U.S. Pat. No. 4,486,117 issued on Dec. 4, 1984 to Herbert Blau, titled "Flexible Traffic Standard," describes an anchor or base for a single leaf strap of spring steel. The single leaf of the Blau device is considerably more flexible than the plural laminations of the present column or support, and cannot provide the combination of rigidity for supporting a relatively large sign, and flexibility for precluding damage when struck, as provided by the present invention. Moreover, the single lamination of the Blau device provides no means for adjusting the friction, and thus the resilience, between the adjacent members, as provided by the present invention.

U.S. Pat. No. 4,958,954 issued on Sep. 25, 1990 to Donald W. Schmanski et al., titled "Horizontal Reflective Highway Marker," describes a T-shaped reflective portion, with each arm or member having a curved cross section. The entire device is molded of ABS plastic or the like, rather than being formed of metal, as in the present invention. Moreover, the Schmanski et al. reflector is only a single panel, rather than the present plural laminations.

U.S. Pat. No. 5,028,166 issued on Jul. 2, 1991 to Layne S.

Leishman, titled "Highway Guidepost," describes a post and driver combination, with the post being formed as a single component of extruded thermoplastic material or the like. Leishman does not use metal for the guidepost itself, but only for the tools used to set his guidepost. No multiple leaf metal support or post structure is disclosed by Leishman, as provided by the present invention.

Finally, U.S. Pat. No. 5,267,523 issued on Dec. 7, 1993 to Denis P. Hugron, titled "Resilient Signalling Post," describes a post formed of a polycarbonate plastic material. The post is essentially a single, monolithically formed component, having a curved shape with a central longitudinal interior passage. No plural laminated metal plies are disclosed by Hugron, as provided in the present invention.

None of the above inventions and patents, taken either singly or in combination, is seen to describe the instant invention as claimed.

SUMMARY OF THE INVENTION

The present invention comprises a flexible support which may be used as a traffic delineator, or for supporting a larger sign or other object as desired. The present support is formed by mechanically securing a plurality of elongate curved metal slats or leaves together to form a laminated structure, with the curvature being about the longitudinal axis of the structure. The assembly is installed preferably with the concave side of the curvature facing the normal direction of traffic. When the device is struck by a vehicle, the multiple laminations of thin metal leaves permit the support to flex to absorb the impact, while the curvature and resilience of the spring metal slats cause the support to resume its normal upright position after the impact force is removed.

The resiliency of the device may be adjusted by means of one or more tension adjustment devices, which may be bolted through the laminated panels or secured about the panels by lateral fasteners. The present support may be used for supporting and displaying a traffic delineator marker, or for the support of a larger sign or plurality of signs, by adjusting the number of laminations composing the support. Additional brackets for the display of additional signs may be secured to the support, either by fastening through the laminations or by securing the bracket(s) about the laminations by lateral fasteners. The present flexible support is also adaptable for use in displaying a street sign or the like, supported at the upper end of the support column.

Accordingly, it is a principal object of the invention to provide an improved flexible support for resiliently supporting a highway sign, marker, or other article thereon.

It is another object of the invention to provide an improved flexible support formed of a plurality of relatively wide, thin elements mechanically secured together.

It is a further object of the invention to provide an improved flexible support which elements are curved about their longitudinal axes, for providing additional rigidity until struck.

Another object of the invention is to provide an improved flexible support including tension adjustment which may be secured either through or surrounding the support column as desired.

Still another object of the invention is to provide an improved flexible support which tension adjustment means may be used for the attachment of one or more signs or additional sign supporting brackets to the support column.

These and other objects of the present invention will become apparent upon review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention comprises various embodiments of a flexible support, for providing resiliency when struck by a vehicle or other object. The present flexible support embodiments are particularly well suited for use in the traffic industry for use as traffic delineators, road, highway, and street signs, etc., although it will be appreciated that the present flexible support lends itself to other uses as well.

Figure 1:
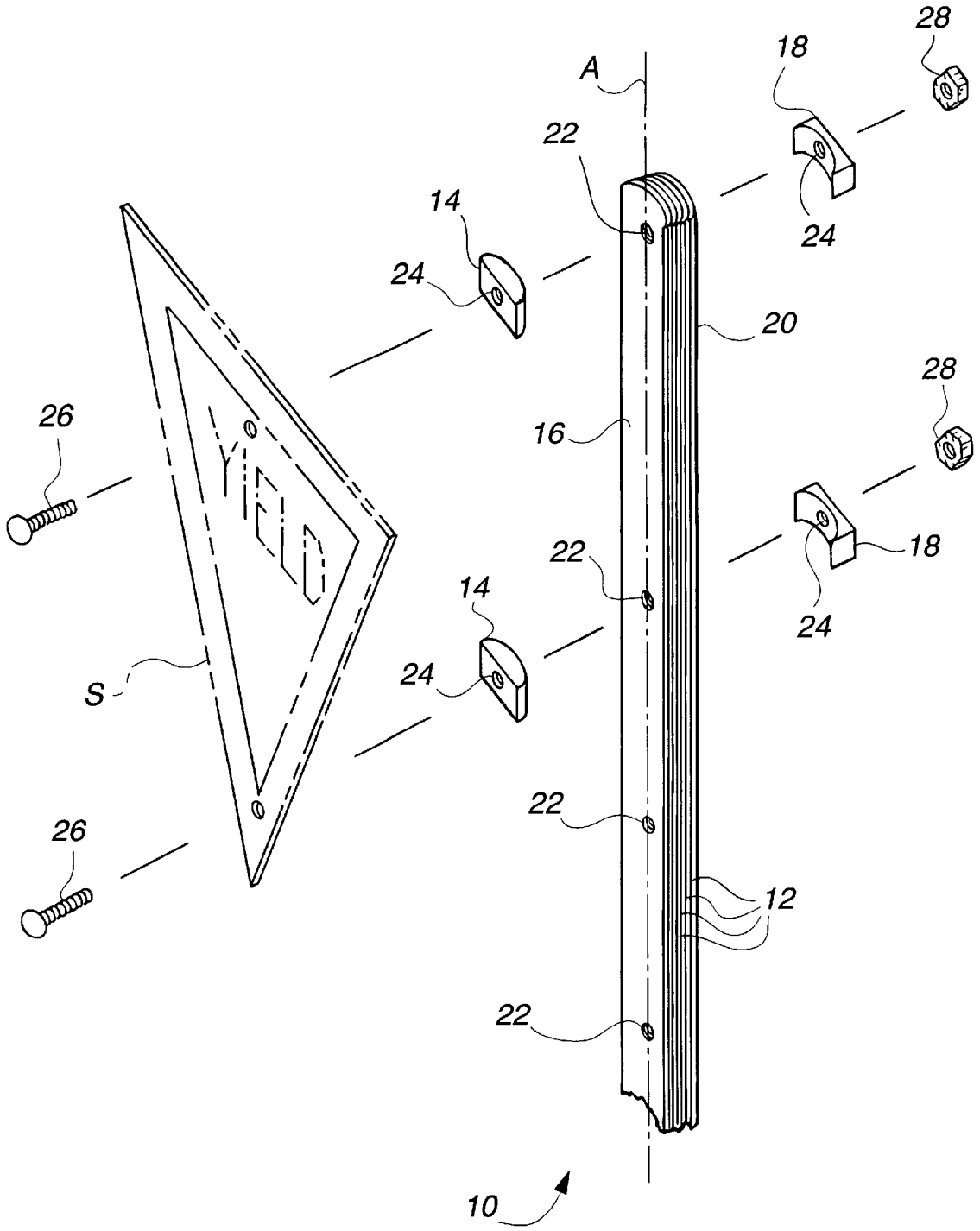
FIG. 1 is an exploded perspective view of a first embodiment of the present flexible support, showing the various elements thereof and their relationships to one another.
Figure 2:
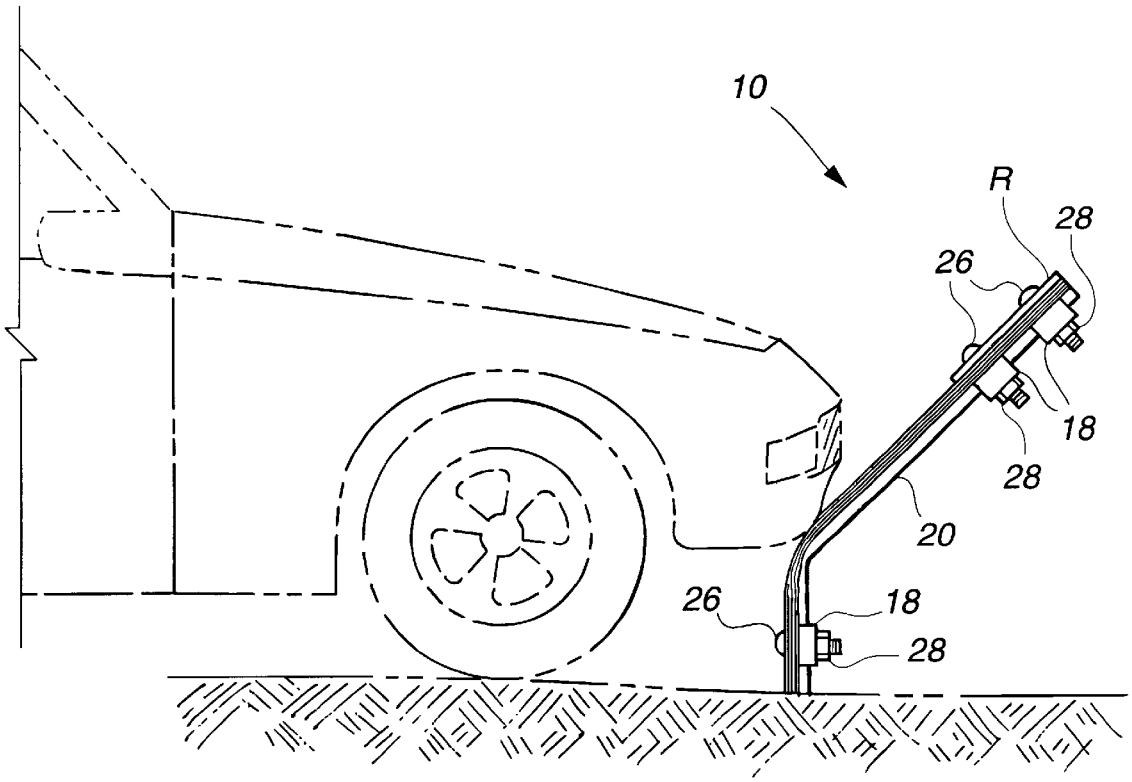
FIG. 2 is an environmental side elevation view, showing the flexible action of the present flexible support and the nature of the flexible bending occurring therein when struck.
Figure 3:
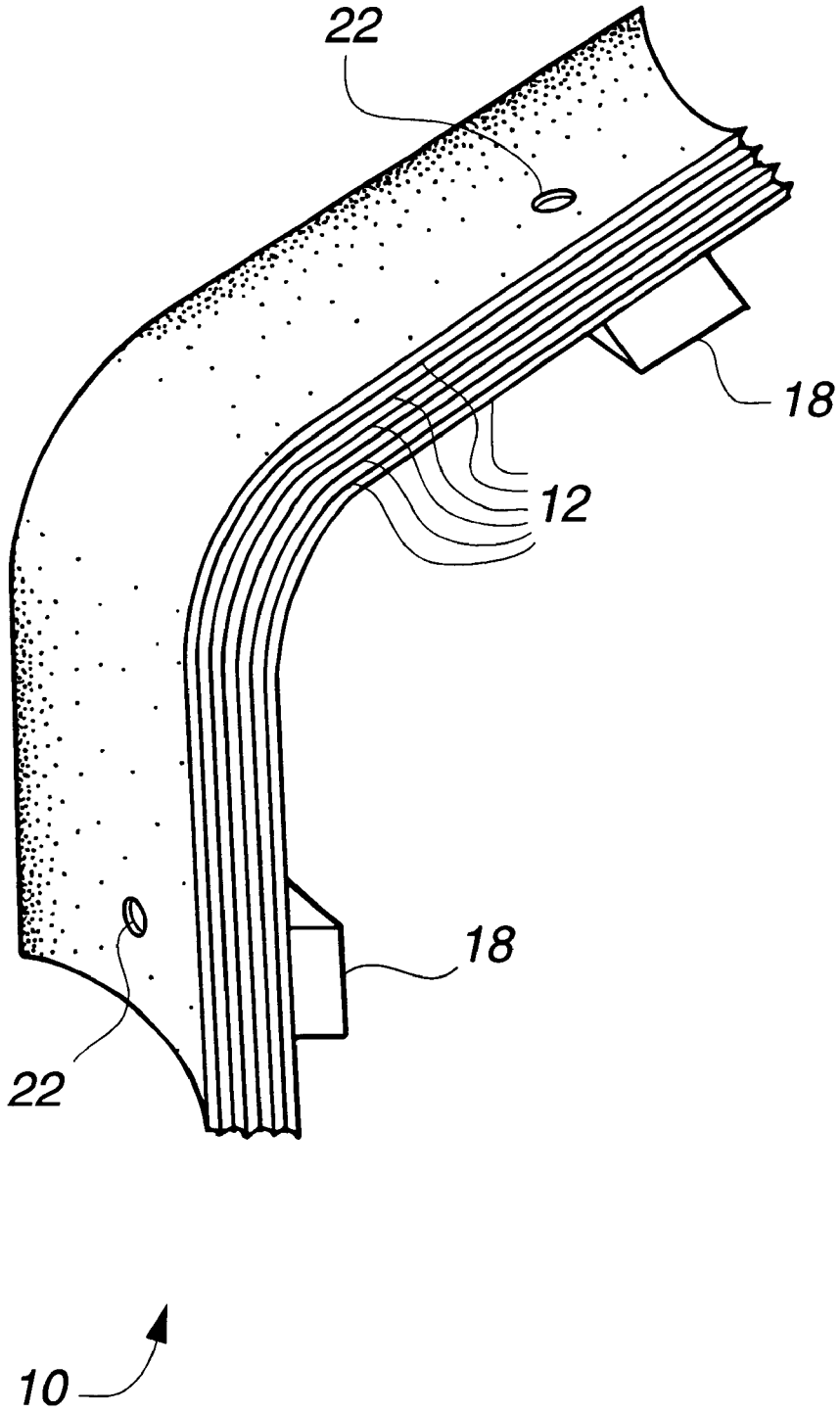
FIG. 3 is a detailed perspective view of the flexing action of the present flexible support.

FIGS. 1 through 3 illustrate a first embodiment of the present flexible support, designated generally by the reference numeral 10. The flexible support 10 is basically formed by a plurality of identical individual thin, wide, elongate, flexible spring steel elements 12, congruently laminated together. Each of the elements 12 is preferably formed of a resilient spring steel, although other materials may be used as desired, with the thickness and width of each blade or element being adjusted accordingly. The preferred spring steel material provides the desired resiliency and return after being deformed, while the multiple plies provide the desired stiffness to support a sign or other object when no other undue loads are imposed. The number of laminations may be adjusted as desired, with fewer elements being used for such purposes as traffic delineators where greater flexibility and no support of another object are required, with a larger number of elements being used where a stiffer support is required for supporting one or more larger traffic signs or the like, or other objects.

Preferably, all of the individual elements 12 are identical to one another, with each preferably having an arcuately curved shape about its elongate major axis A, as shown in FIG. 1. The curved shape provides additional stiffness for each of the elements 12, with the lateral curvature of each element resisting bending in a direction normal thereto. When the present support column 10 is bent, as shown in FIGS. 2 and 3, the lateral curvature of each of the elements 12 must be straightened since the material accepts only a simple curvature in one dimension at any one time. The need for straightening the normal lateral curvature of each of the elements 12 results in a greater resistance to bending across the elongate axis A, thus stiffening the structure. This normal curvature formed in the elements 12 provides a straightening force for the elements and the support 10 formed therefrom, with the resilience of the spring steel or other suitable material urging support 10 back to its normally straight condition after bending.

In the first embodiment of FIGS. 1 through 3, the plurality of elements 12 are mechanically secured together by one or more clamp assemblies, which also serve to adjust the bending resistance of the support 10 and as mounting means for signs and the like which may be secured to the support 10. These clamp assemblies each comprise a convex component 14 having a curvature closely fitting the concave curvature of the front side 16 (i. e., the side facing traffic) of the support 10, and an opposite concave component 18 having a curvature closely fitting the rearward convex curvature of the rearward side of the support 10.

Each of the elements 12 of the support column 10 may be provided with a plurality of holes or passages 22 therethrough, with each of the clamp members 14 and 18 also being provided with similar holes or passages 24. A plurality of elements 12 are assembled congruently together, with each set of holes 22 being in alignment with one another. Two complementary clamp members 14 and 18 are assembled on opposite concave and convex sides 16 and 20 of the support assembly 10 in alignment with one of the holes 22, and a bolt 26 is inserted through the holes 24 of the clamp members 14 and 18 and the corresponding holes 22 of the support assembly 10. The assembly is then secured with a cooperating nut 28.

It will be seen that the more tightly the bolt(s) 26 and corresponding nut(s) 28 are secured together, the greater will be the pressure and friction between each of the individual elements 12 of the support assembly 10. Thus, by adjusting the final torque applied to the nuts 28 to a predetermined value during assembly, the frictional binding of the support column assembly 12, and thus the resistance to bending and straightening of the assembly 12, may be adjusted as desired according to the specific installation environment. In FIG. 1, the assembly may be secured relatively tightly together, with the uppermost bolts 26 also being used to secure a traffic sign S to the upper portion of the support 10. The tighter assembly, and corresponding greater resistance to bending, will preclude the assembly bending over due to wind effects upon the relatively large sign area, in combination with the longer arm of the taller sign support of FIG. 1.

The assembly may also be adjusted to provide less bending resistance, as in the traffic delineator support of FIG. 2. It will be seen that the basic components of the support 10 of FIG. 2 are the same as those of FIG. 1. However, a lesser number of individual elements may be used in order to provide less resistance to bending, and the clamping members (only the rearward members 18 are visible in FIG. 2) may be secured more loosely to the support 10 in order to reduce the friction between individual elements and thus reduce the resistance to bending and straightening of the assembled support 10. This is desirable where the support 10 is relatively short, as in the traffic delineator of FIG. 2, and where it may be more likely to be struck by a vehicle. Also, such traffic delineators are provided with only relatively small reflectors R (shown in edge view in FIG. 2, with two clamp or attachment assemblies used for security), with little surface area against which the wind may impart a bending load on the support.

FIG. 3 provides a simplified perspective view of the bending action of the present flexible support 10, with the front or convex clamp members 14 and bolts 26 removed in order to show clearly the lateral flattening across the normal curvature of the elements 12 and assembled support structure 10. (The front member 14 may be deleted, with the rear member 18 being retained by threading the fastener 26 directly into the support elements 12, if so desired.) As described further above, when the assembly is bent, the normal lateral curvature across the front face 16 of the elements is forced to straighten, resisting the bending force across the longitudinal axis, and urging the assembly back to a straightened condition when the bending force is removed. The concave rearward element(s) 18 resist the lateral flattening of the support elements 12, thus further resisting bending across the longitudinal axis.

Figure 4:
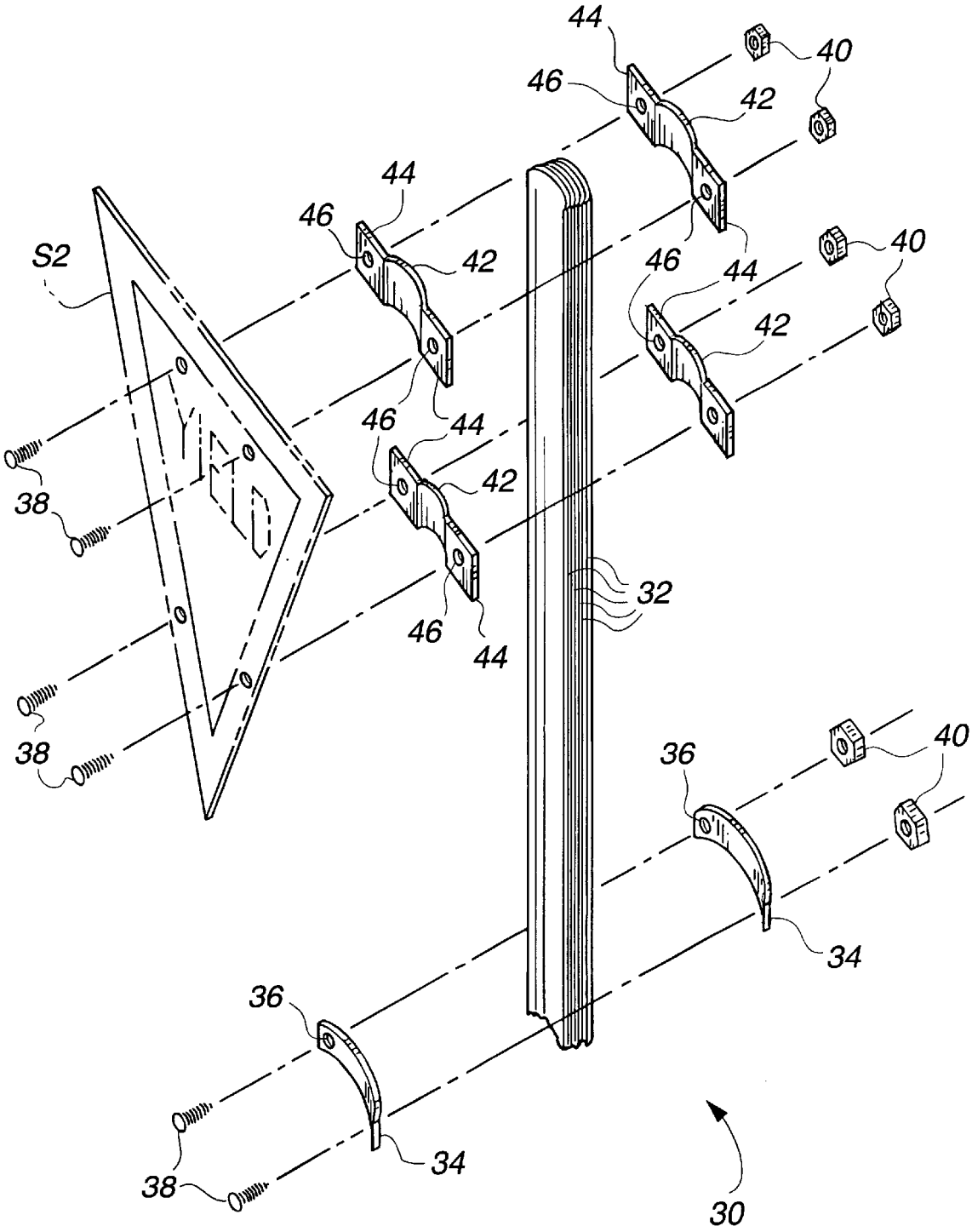
FIG. 4 is an exploded perspective view of a second embodiment of the present flexible support, showing the various elements thereof and their relationships to one another.
Figure 5:
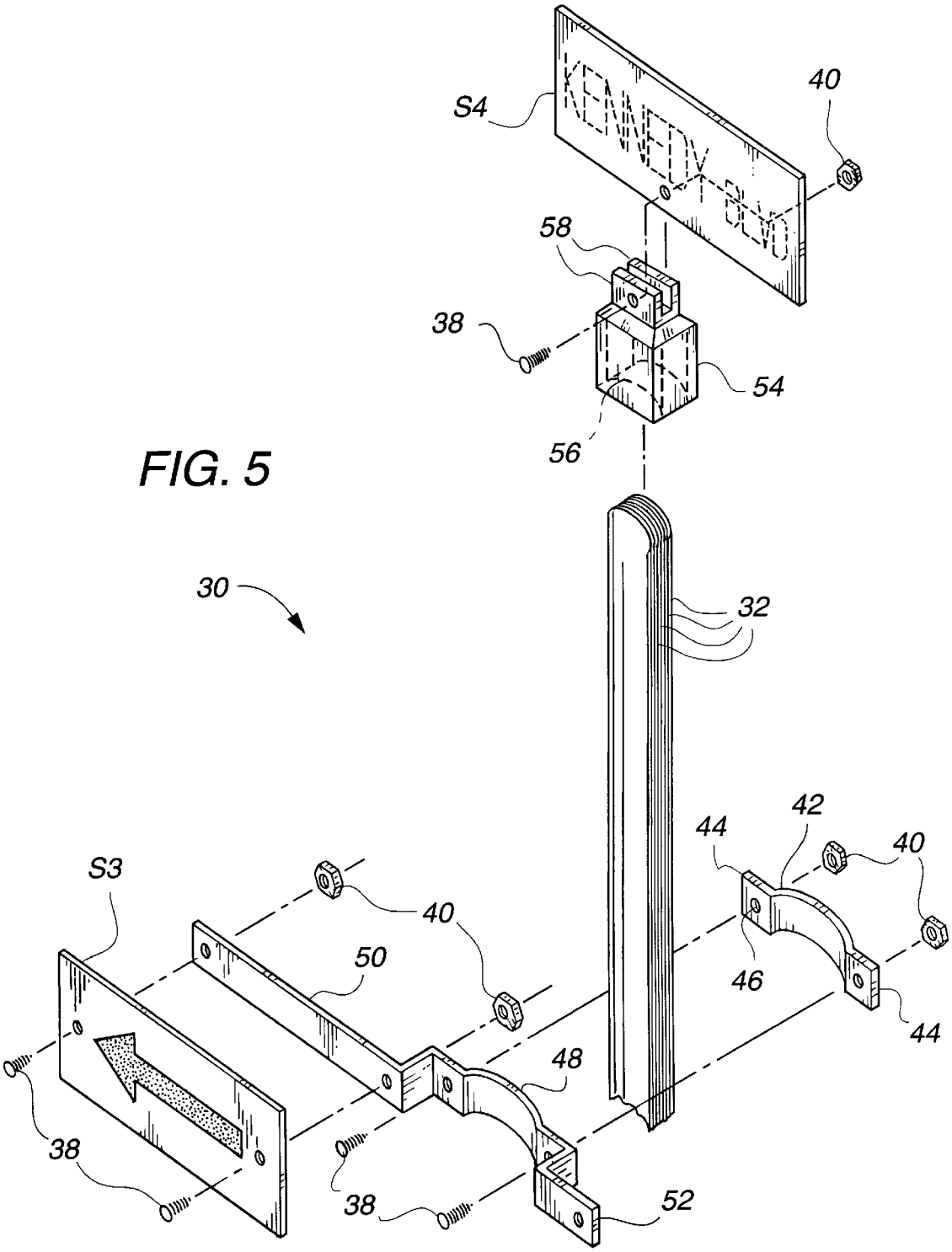
FIG. 5 is an exploded perspective view of the support of FIG. 4, showing additional attachment members for securing thereto.

FIGS. 4 and 5 illustrate an additional embodiment of the present flexible support. The flexible support 30 of FIGS. 4 and 5 is similar to the support 10 of FIGS. 1 through 3, but the individual members 32 lack any holes or passages therethrough. The clamping components comprise identical front and rear elements 34, with each of the elements 34 being curved to match closely the lateral curvature of the flexible elements 32 comprising the flexible support assembly 30. The clamping elements 34 may be stamped or otherwise formed of a reasonably heavy sheet stock material, in order to maintain their shape and curvature when clamping pressure is applied.

Each of the clamping elements 34 has a width somewhat wider than the width of the support assembly 30, with the portions extending beyond each side of the assembly 30 having holes or passages 36 formed therethrough. Bolts 38 and cooperating nuts 40 are installed through a front and opposite rear clamping member 34 which have been assembled to sandwich the assembled laminated elements 32 therebetween, with the nuts 40 and bolts 38 being tightened to a predetermined torque as desired in order to provide the desired frictional resistance to bending between each of the support elements 32, in the manner described further above for the first embodiment of FIGS. 1 through 3.

Additional sign attachment brackets or clamps 42 may also be provided with the support column 30 embodiment of FIGS. 4 and 5, if desired. The sign attachment clamps 42 are each identical for front and back attachment, and each have a curved center portion which fits closely about the concave and convex surfaces respectively of the front and rear sides of the flexible support assembly 30. Additionally, a flat attachment ear or lug 44 extends outwardly from each side of the central curved portion of the clamps 42. The opposed lugs 44 of each clamp 42 are coplanar, to provide a flat mounting surface for the attachment of signs and the like to the support column 30. Each lug 44 includes an attachment hole 46 therethrough. The sign S2 of FIG. 4 includes two bolt holes each through the upper and lower portions thereof, with each pair being spaced apart to be congruent with the spacing of the holes 46 of the clamp attachment lugs 44.

Bolts 38 and cooperating nuts 40 are used to assemble the above described components, with the bolts 38 being passed through the holes in the sign S2, and thence through the clamp lug holes 46 of a pair of clamps 42 which have been placed upon each side of the laminated flexible support assembly 30, thus sandwiching the assembly 30 together. The mating nuts 40 are torqued as desired to a predetermined value, in accordance with the amount of flexibility desired for this portion of the support 30. (The nuts 40 and bolts 38 of the clamps 42 may be torqued relatively tightly in order to hold the sign S2 securely, since little flexing is required of the upper portion of the support 30 and sign S2 mounted thereon.)

FIG. 5 illustrates additional means of securing various signs or other objects to the present flexible support. In the case of FIG. 5, the flexible support 30 has no holes or passages therethrough. However, it will be seen that the various attachment means illustrated in FIG. 5 could be adapted for use with the flexible support 10 with holes 22 therethrough, shown in FIGS. 1 through 3.

The present flexible supports 10 and 30 may be used for the support of a laterally attached sign, such as the directional arrow sign S3 (or other sign or object), by using a "Z" or offset bracket 48 as shown. The bracket 48 is similar to the brackets or clamps 42 discussed above, but includes one or more lateral extensions 50 and/or 52 offset therefrom. Such extensions 50 and/or 52 serve for the attachment of plural signs at a single point on the support column 10 or 30, as when an information sign (not shown) is attached to one side of the bracket 48, with a directional arrow sign S3 corresponding to the information being installed opposite the information sign.

Other signs, such as multiple highway number signs, etc., may be secured to the support column 10 or 30 using the offset bracket 48. Also, the offset bracket 48 allows signs (such as the sign S3) to be secured very tightly to the offset arm 50, while still allowing the clamping bolts and nuts to be torqued to a lesser value as desired, in order to allow the desired flexibility for the support column 10 or 30.

In addition to the various clamps and sign attachments described further above, an upper sign attachment or cap may be provided for the attachment of a street name sign or the like to either of the embodiments 10 or 30 of the present invention. FIG. 5 illustrates such a sign attachment cap 54 having a socket 56 therein formed to fit closely about the curved shape of the plural laminations 32 forming the support 30. A pair of spaced apart lugs 58 are formed in the top of the cap 54, for the placement of a sign S4 therein. The sign S4 may be secured to the cap 54 by a bolt and nut, respectively 38 and 40. The cap 54 may be positively secured to the upper end of the support column 30 by means of a conventional hole or passage therethrough (not shown) and corresponding hole or passage formed through the upper end of the support 30, in the manner of the holes 22 formed through the support elements 12 of the support 10 of FIGS. 1 through 3.

Alternatively, the cap 54 may be formed somewhat like the clamps 42 discussed further above, but with each clamp 42 having an upper extension for sandwiching the bottom edge of the sign S4 therebetween. Two such clamps could then be used to sandwich the upper end of the support 30 therebetween, with the sign S4 being secured between the upper extensions of such clamps. This would enable such a sign S4 to be secured to the upper end of a flexible support column 30 not having any holes formed therein.

In summary, the present flexible support in its various embodiments provides an important solution to the problem of posts, supports, and the like which must be sufficiently rigid and durable to support a sign or other object and withstand normal wear and tear, yet which must also handle vehicle or other impacts. The present flexible supports do so without requiring further maintenance or repair after such an impact, by resiliently bending upon impact to allow the vehicle or impacting object to pass over the support and any sign or other article secured thereto. The support then straightens to its original position when the bending force is removed, with the signage thereon being displayed in its original position.

The present flexible supports provide for adjustment of the resistance to bending force, by adjusting the number of individual units used to form a completed flexible support lamination. Further adjustment is provided by the clamping elements used to secure the elements together. These clamps serve multiple functions, in that they (1) provide for securing the individual support components together, (2) provide for the adjustment of the clamping pressure, and thereby the frictional resistance to bending between each of the individual flexible components, and (3) provide for the securing of signage or another article(s) to the support assembly.

Alternative clamping means may be provided, to provide for the laterally offset attachment of multiple signs or other objects to the present posts, if so desired. In addition, an upper cap may be provided for the support post assembly, enabling a sign or other object to be secured to the upper end of the support, if so desired. The present flexible support in its various embodiments will thus be seen to provide a much needed means of flexibly displaying traffic and other signage, traffic delineators, and other signs and objects where it is critical that the signage be displayed continually, and where such signage is at some risk of damage due to impact from vehicles or other causes. The present flexible support provides a much needed and economical solution to the problem of displaying such signs and articles, and will prove most valuable to the traffic safety and control industry.

It is to be understood that the present invention is not limited to the embodiments described above, but encompasses any and all embodiments within the scope of the following claims.

I claim:

1. A flexible support, comprising:

a plurality of identical individual thin, wide, elongate, flexible spring steel elements;

said elements being congruently laminated and clamped together by mechanical fasteners to form a single flexible and resilient column;

said elements including a plurality of congruent fastener holes formed therethrough, with said mechanical fasteners passing through said fastener holes for clamping said elements together.

2. The flexible support according to claim 1, including bending resistance adjustment means for adjusting the resistance to bending of said elements.

3. The flexible support according to claim 2, wherein said elements are adjustably clamped together by a plurality of mechanical fasteners for providing a compressive clamping pressure, and said bending resistance adjustment means comprises adjusting said fasteners for adjusting said clamping pressure as desired.

4. The flexible support according to claim 1, including sign attachment means.

5. The flexible support according to claim 4, wherein said sign attachment means comprises:

at least one pair of clamps for sandwiching said elements therebetween;

said clamps each having a curved center portion, for fitting closely about said elements; and said clamps each further having first and second flat attachment lugs extending oppositely from one another, for fastening said clamps and at least one sign to said elements.

6. The flexible support according to claim 1, wherein each of said elements has a longitudinal axis with a curvature about said longitudinal axis for stiffening said support along said longitudinal axis of said elements.

7. The flexible support according to claim 1, wherein said mechanical fasteners surround said elements for clamping said elements together.

8. The flexible support according to claim 1, wherein said elements have a common upper end including a sign mounting cap.

9. A flexible support, comprising:

a plurality of identical individual thin, elongate, flexible elements;

each of said elements having a longitudinal axis, and having a curvature about said longitudinal axis;

said elements being congruently laminated together for forming a single flexible and resilient column; and bending resistance adjustment means for adjusting the resistance to bending of said elements.

10. The flexible support according to claim 9, wherein said elements are clamped together by mechanical fasteners.

11. The flexible support according to claim 10, wherein said elements include a plurality of congruent fastener holes formed therethrough, with said mechanical fasteners passing through said fastener holes for clamping said elements together.

12. The flexible support according to claim 10, wherein said mechanical fasteners surround said elements for clamping said elements together.

13. The flexible support according to claim 9, including sign attachment means.

14. The flexible support according to claim 13, wherein said sign attachment means comprises:

at least one pair of clamps for sandwiching said elements therebetween;

said clamps each having a curved center portion, for fitting closely about said elements; and said clamps each further having first and second flat attachment lugs extending oppositely from one another, for fastening said clamps and at least one sign to said elements.

15. The flexible support according to claim 9, wherein each of said elements is formed of spring steel.

16. The flexible support according to claim 9, wherein said elements are adjustably clamped together by a plurality of mechanical fasteners for providing a compressive clamping pressure, and said bending resistance adjustment means comprises adjusting said fasteners for adjusting said clamping pressure as desired.

17. The flexible support according to claim 9, wherein said elements have a common upper end including a sign mounting cap secured thereto.

* * * * *